United States Patent [19]

Matthews

[11] 4,005,585

[45] Feb. 1, 1977

[54] CONTROL ARRANGEMENT FAIL-SAFE TIMING CIRCUIT

[75] Inventor: Russell B. Matthews, Goshen, Ind.

[73] Assignee: Johnson Controls, Inc., Milwaukee, Wis.

[22] Filed: June 9, 1975

[21] Appl. No.: 585,237

Related U.S. Application Data

[62] Division of Ser. No. 447,165, March 1, 1974, Pat. No. 3,970,864.

[52] U.S. Cl. ..... 62/158; 62/193; 318/452

[51] Int. Cl.[2] ..... F25B 31/00; G05D 23/32

[58] Field of Search ..... 62/193, 157, 158; 318/481, 452; 307/118; 417/13

[56] References Cited

UNITED STATES PATENTS

| | | | |
|---|---|---|---|
| 3,321,669 | 5/1967 | Rhodes | 317/41 |
| 3,931,560 | 1/1976 | Willson | 62/158 |

*Primary Examiner*—William E. Wayner

*Attorney, Agent, or Firm*—Johnson, Dienner, Emrich & Wagner

[57] ABSTRACT

A fail-safe timing circuit energizable in response to a starting signal for activating a system, such as an air conditioning system, includes a first switching circuit responsive to the request signal to activate the system to commence its operation tentatively, a time-out circuit responsive to the starting signal for generating a time-out signal after a predetermined time delay interval, a circuit responsive to a system variable such as the compressor oil pressure achieving a given desired value, for preventing the time-out circuit from generating its time-out signal, and a second switching circuit for causing the first switching circuit to de-activate the system in response to the time-out signal. As a result, the system is prevented from operating in an undesirable or unwanted manner should the system variable not reach the predetermined condition within the timing interval.

7 Claims, 1 Drawing Figure

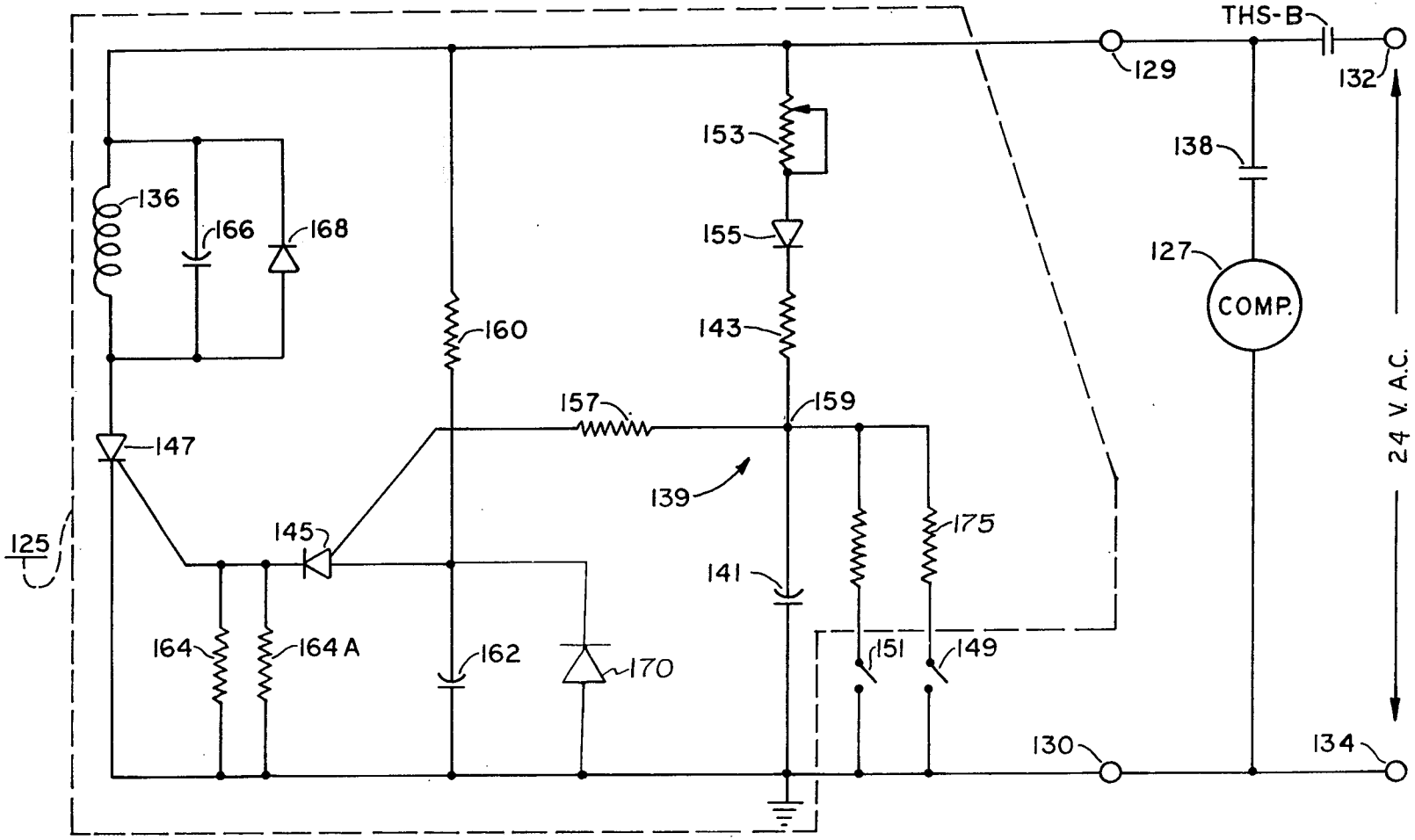
24 V A.C.
132
134
THS-B
COMP.
138
127
129
130
175
149
151
159
153
155
143
141
139
157
170
160
162
168
145
164 A
166
164
136
147
125

CONTROL ARRANGEMENT FAIL-SAFE TIMING CIRCUIT

This is a division of application Ser. No. 447,165 filed Mar. 1, 1974, now U.S. Pat. No. 3,970,864.

BACKGROUND OF THE INVENTION

1. Field of the Invention

The present invention relates to a control arrangement fail-safe timing circuit, and it more particularly relates to an automatic electronic fail-safe timing circuit for controlling the activation of a system, such as a fuel ignition system or an air conditioning system.

2. Description of the Prior Art

Control arrangements for systems, such as air conditioning systems, have been employed to selectively activate and de-activate the systems. For example, in air conditioning systems, control arrangements have been provided to initiate automatically the operation of a compressor for the system. However, if the oil pressure of the compressor does not increase to an acceptable level in a reasonable period of time, it is desirable to de-activate the compressor unit and restart it subsequently. Therefore, it would be highly desirable to have a control arrangement fail-safe timing circuit, which would prevent undesirable and unwanted conditions of the system from occurring, such as the causing of the operation of an air conditioning compressor without sufficient oil pressure.

SUMMARY OF THE INVENTION

Therefore, it is the principal object of the present invention to provide a new and improved control arrangement fail-safe timing circuit, which prevents certain conditions from occurring, such as unwanted or undesirable conditions in air conditioning systems.

The present invention provides a fail-safe timing circuit including a first switching circuit responsive to a request signal to activate the system to commence its operation tentatively, a time-out circuit responsive to the request signal for generating a time-out signal after a predetermined time delay interval, a circuit responsive to a system variable becoming a predetermined condition for preventing the timing circuit from generating its time-out signal, and a second switching circuit for causing the first switching circuit to de-activate the system in response to the time-out signal. Other features relate to the resetting of the timing circuit.

DESCRIPTION OF THE DRAWING

The single FIGURE, which is the only drawing of the application, is a schematic circuit diagram of a control arrangement fail-safe timing circuit for an air conditioning system in accordance with the present invention.

DESCRIPTION OF A PREFERRED EMBODIMENT

Referring to the drawing, there is shown a fail-safe timing circuit 125 which is adapted to control the energization of a compressor 127 of an air conditioning system (not shown). The circuit 125 is utilized as an oil pressure protector circuit which prevents the air conditioner compressor 127 from operating if its differential oil pressure drops below a predetermined value. Also, the circuit 125 permits the compressor 127 to run for approximately 30 seconds before disabling it should its differential oil pressure drop below the predetermined value. Alternatively, if the oil pressure of the compressor 127 increases to an acceptable level within the predetermined time interval of 30 seconds, the circuit 125 as hereinafter described in greater detail allows the compressor 127 to continue to operate.

The circuit 125 includes a pair of input terminals 129 and 130 which are connected respectively through a normally-opened thermostatically-controlled switch THS-B to a power terminal 132 and directly to another power terminal 134, a source (not shown) of 24 volt AC power being connected across the power terminals 132 and 134 to activate the circuit 125. A relay 136 of the circuit 125 has normally-open contacts 138 connected between the terminal 129 and the compressor 127, which is connected between the contacts 138 and the power terminal 134 so that when the relay 136 is operated to close its contacts 138, the compressor 127 is activated when the thermostatically-controlled contacts THS-B are closed to request the operation of the air conditioning system. A time-out circuit 139, including a timing capacitor 141 connected in series with a resistor 143, generates a time-out signal at the end of a predetermined timeout delay interval to render non-conductive a programmable unijunction transistor 145 and a silicon-controlled rectifier 147 to cause the relay 136 to be de-energized, whereby the contacts 138 open to de-activate the compressor 127. Normally-opened differential oil pressure switch contacts 149 close when the differential oil pressure of the compressor 127 exceeds a predetermined value to maintain the PUT device 145 and the SCR 147 conductive so that the relay 136 remains operated to cause the compressor 127 to remain operative. A normally-open manually operable switch 151 serves as a reset switch for the circuit 125 by enabling the timing capacitor 141 to be discharged manually as hereinafter described in greater detail.

Considering now the circuit 125 in greater detail, a variable resistor 153 is connected between the input terminal 129 and a suitably-poled diode 155 which serves as a half-wave rectifier for the PUT transistor 145, and which is connected through a current-limiting resistor 143 and the timing capacitor 141 to the grounded terminal 130. A resistor 157 is connected between the gate of the PUT transistor 145 and a point 159 between the resistor 143 and the capacitor 141 to bias the gate of the transistor 145 depending upon the potential on the capacitor 141 as hereinafter described in greater detail. A resistor 160 is connected between the terminal 129 and the anode of the transistor 145, a capacitor 162 being connected between the anode of the transistor 145 to the grounded terminal 130 to bias the transistor 145 relative to the bias provided by the capacitor 141. A pair of redundant resistors 164 and 164A are connected in parallel between the gate of the SCR 147 and the grounded terminal 130, the gate of the SCR 147 being connected also directly to the cathode of the transistor 145. A capacitor 166 is connected in parallel with a suitably poled diode 168, and the pair of the capacitor 166 and the diode 168 are connected across the relay 136 to render it slow to release for the purpose of maintaining it operative during negative half cycles when the transistor 145 and the SCR 147 are rendered non-conductive as a result of the half-wave rectifying diode 155.

Considering now the operation of the circuit 125, assuming that the thermostatically-controlled switch THS-B generates a request signal by closing the circuit from the power terminals 132 and 134 to the input terminals 129 and 130, current flows through a path including the variable resistor 153, the diode 155, the resistor 143 and the capacitor 141 to the grounded terminal 130. Current also flows from the terminal 129 through the path, including the resistor 160, and the capacitor 162, to the grounded terminal 130. The voltage on the capacitor 141 determines the charge on the capacitor 162 in that the voltage on the capacitor 141 plus a +0.6 volts equals the voltage on the capacitor 162 due to the conduction of the PUT transistor 145. Thus, during each positive half cycle of the power signal, the capacitor 162 charges at a faster rate than the capacitor 141 so that eventually the voltage on the anode of the transistor 145 is greater than the voltage at the gate by approximately 0.6 volts, whereby the transistor 145 conducts to enable the capacitor 162 to discharge through the redundant resistors 164 and 164A. As a result, the SCR 147 conducts to cause the relay 136 to operate. The relay 136 operates and closes its contacts 138 for enabling the compressor 127 to be activated tentatively. During the next negative portion of the power signal, the diode 155 blocks the capacitor 141, and the capacitor 162 is bypassed by diode 170 during the negative portion of the sine wave. During the next positive half cycle, the operation is repeated to generate another pulse to operate the SCR 147 to maintain the relay 136 operated. If the differential oil pressure switch 149 does not close within a predetermined time delay interval of approximately 30 seconds, the voltage on capacitor 141 and the gate of the PUT device 145 exceeds the anode voltage to cause the PUT device 145 to discontinue conducting during both half cycles of the power signal. As a result, the SCR 147 similarly ceases its conduction so that the relay subsequently restores to turn off the compressor. If the oil pressure rises to an acceptable level and the contacts 149 close, the voltage on the capacitor 141, instead of charging to the line voltage, is held to a reduced value determined by the voltage divider network of resistors 153, 143 and 175 which prevents the gate voltage on the PUT device 145 from exceeding the voltage on the anode, whereby the SCR 147 continues to conduct to maintain the relay 136 operated.

The following Table I is a list of component values which may be used for the circuit 125:

Table I

| | |
|---|---|
| Capacitor 141 | 10 Microfarads |
| Resistor 143 | 2.7 Meg ohms |
| PUT 145 | 2N6028 |
| SCR 147 | C106B |
| Resistor 153 | 1 Meg ohm |
| Resistor 157 | 2.2 Meg ohms |
| Resistor 160 | 12K Ohms |
| Capacitor 162 | 0.47 Microfarads |
| Resistors 164, 164A | 220 Ohms |
| Capacitor 166 | 22 Microfarads |
| Resistor 175 | 2.2 Meg ohms |

I claim:

1. In an air conditioning control arrangement for activating an air conditioning system, a fail-safe timing circuit energizable in response to a request signal to initiate the operation of a compressor for the air conditioning system, said fail-safe timing circuit comprising first switching means operable when enabled to activate the compressor to commence its operation tentatively second switching means, first timing means responsive to said request signal for controlling said second switching means to enable said first switching means, second timing means responsive to said request signal for generating a time-out signal after a predetermined time delay interval for inhibiting said first timing means whereby said first and second switching means are disabled to de-activate the compressor, and circuit means responsive to the oil pressure of the compressor becoming a predetermined value for preventing said second timing means from generating its time-out signal.

2. A fail-safe timing circuit according to claim 1, further including discharge circuit means for resetting said second timing means responsive to the absence of said request signal.

3. In an air conditioning control arrangement for activating a system, a fail-safe timing circuit energizable in response to a request signal to initiate the operation of a compressor for the air conditioning system, said fail-safe timing circuit comprising first switching means operable when enabled to activate the compressor to commence its operation tentatively, first charge retaining means responsive to said request signal for charging toward a given potential at a first rate, second charge retaining means responsive to said request signal for charging toward said given potential at a second rate, second switching means controlled by said first and said second charge retaining means and operable whenever the potential difference between said first and second charge retaining means reaches a predetermined value to enable said first switching means, said second charge retaining means causing said second switching means and thus said first switching means to de-activate the compressor when said second charge retaining means becomes charged to said given potential and an oil pressure switch responsive to the oil pressure of the compressor exceeding a predetermined value of pressure for preventing said second charge retaining meas from causing the compressor from becoming de-activated.

4. A fail-safe timing circuit according to claim 3, further including manual switching means operable in parallel with said pressure switch for resetting said fail-safe timing circuit.

5. A fail-safe timing circuit according to claim 4, wherein said second switching means includes pulse means for producing a series of pulses to cause said first switching means to become operative during each pulse and for permitting said first switching means to become inoperative alternately in the absence of said pulses, said pulse means including delay means for maintaining the system operative for a predetermined time delay interval, said interval being substantially greater than the interval of time between said pulses.

6. A fail-safe timing circuit according to claim 5, wherein said pulse means includes a rectifying means for converting alternating current signals to halfwave rectified signals for producing said pulses.

7. A fail-safe timing circuit according to claim 6, wherein said first switching means includes a first bi-stable device for controlling said system and a second bi-stable device for controlling said second bi-stable device in response to said pulses.

* * * * *